US007662051B2

(12) United States Patent
Chen

(10) Patent No.: US 7,662,051 B2
(45) Date of Patent: Feb. 16, 2010

(54) GOLF HEAD

(75) Inventor: Archer C. C. Chen, Taichung (TW)

(73) Assignee: Cindy Rhodes, Taichung (TW)

( * ) Notice: Subject to any disclaimer, the term of this patent is extended or adjusted under 35 U.S.C. 154(b) by 199 days.

(21) Appl. No.: 11/853,659

(22) Filed: Sep. 11, 2007

(65) Prior Publication Data

US 2009/0069116 A1 Mar. 12, 2009

(51) Int. Cl.
*A63B 53/04* (2006.01)

(52) U.S. Cl. ..... 473/342; 473/350

(58) Field of Classification Search ..... 473/324–350
See application file for complete search history.

(56) References Cited

U.S. PATENT DOCUMENTS 5,584,770 A * 12/1996 Jensen ..... 473/350
5,665,014 A * 9/1997 Sanford et al. ..... 473/345
5,683,310 A * 11/1997 Chen ..... 473/349
5,755,627 A * 5/1998 Yamazaki et al. ..... 473/345
5,776,011 A * 7/1998 Su et al. ..... 473/345
6,179,726 B1 * 1/2001 Satoh et al. ..... 473/290
6,491,593 B2 * 12/2002 Takeda ..... 473/342
6,506,129 B2 * 1/2003 Chen ..... 473/329
6,575,845 B2 * 6/2003 Smith et al. ..... 473/329
6,623,378 B2 * 9/2003 Beach et al. ..... 473/345
6,645,086 B1 * 11/2003 Chen ..... 473/335
6,663,504 B2 * 12/2003 Hocknell et al. ..... 473/329
6,739,983 B2 * 5/2004 Helmstetter et al. ..... 473/342
6,758,763 B2 * 7/2004 Murphy et al. ..... 473/342
6,805,643 B1 * 10/2004 Lin ..... 473/345
6,872,152 B2 * 3/2005 Beach et al. ..... 473/324
6,878,073 B2 * 4/2005 Takeda ..... 473/346
6,881,159 B2 * 4/2005 Galloway et al. ..... 473/345
6,918,841 B2 * 7/2005 Chen ..... 473/342
6,923,733 B2 * 8/2005 Chen ..... 473/305
6,932,875 B2 * 8/2005 Cheng et al. ..... 148/522
6,971,961 B2 * 12/2005 Chen ..... 473/342
6,984,181 B2 * 1/2006 Hettinger et al. ..... 473/340
6,994,636 B2 * 2/2006 Hocknell et al. ..... 473/342
7,041,005 B2 * 5/2006 Beach et al. ..... 473/345
7,059,973 B2 * 6/2006 Erickson et al. ..... 473/345
7,066,835 B2 * 6/2006 Evans et al. ..... 473/346

(Continued)

FOREIGN PATENT DOCUMENTS

JP 04012771 A * 1/1992

(Continued)

*Primary Examiner*—Alvin A Hunter
(74) *Attorney, Agent, or Firm*—Browdy and Neimark, PLLC

(57) ABSTRACT

Present invention is relative to a golf head. The golf head includes a main part. The main part that is made of metal includes a body portion and a neck portion. A hitting part, which is made of metal that is harder than the main part, has a face portion and a bottom portion. The bottom portion that extrudes from the bottom of the face portion is modeled with the face portion integral whole. The hitting part connects with the body portion of the main part by the rim. The back of the face portion and the top of the bottom portion, which closes to the face portion, suspend in midair. The connective position of the body portion and the rear of the bottom portion crosses the central line of the bottom of the golf head and is partial to rear.

9 Claims, 6 Drawing Sheets

U.S. PATENT DOCUMENTS

| | | | | |
|---|---|---|---|---|
| 7,118,493 | B2 * | 10/2006 | Galloway | 473/329 |
| 7,121,955 | B2 * | 10/2006 | Stevens et al. | 473/334 |
| 7,125,344 | B2 * | 10/2006 | Hocknell et al. | 473/345 |
| 7,128,662 | B2 * | 10/2006 | Kumamoto | 473/345 |
| 7,128,664 | B2 * | 10/2006 | Onoda et al. | 473/347 |
| 7,147,576 | B2 * | 12/2006 | Imamoto et al. | 473/334 |
| 7,175,541 | B2 * | 2/2007 | Lo | 473/345 |
| 7,207,899 | B2 * | 4/2007 | Imamoto | 473/332 |
| 7,255,654 | B2 * | 8/2007 | Murphy et al. | 473/345 |
| 7,258,628 | B2 * | 8/2007 | Huang et al. | 473/342 |
| 7,273,419 | B2 * | 9/2007 | Evans et al. | 473/328 |
| 7,320,646 | B2 * | 1/2008 | Galloway | 473/224 |
| 7,338,387 | B2 * | 3/2008 | Nycum et al. | 473/332 |
| 7,367,900 | B2 * | 5/2008 | Kumamoto | 473/345 |
| 7,371,188 | B2 * | 5/2008 | Chen | 473/329 |
| 7,387,577 | B2 * | 6/2008 | Murphy et al. | 473/305 |
| 7,396,296 | B2 * | 7/2008 | Evans | 473/344 |
| 7,402,112 | B2 * | 7/2008 | Galloway | 473/224 |
| 7,452,287 | B2 * | 11/2008 | Erickson et al. | 473/345 |
| 7,455,600 | B2 * | 11/2008 | Imamoto et al. | 473/345 |
| 7,491,134 | B2 * | 2/2009 | Murphy et al. | 473/329 |

FOREIGN PATENT DOCUMENTS

| | | | | |
|---|---|---|---|---|
| JP | 04012772 | A | * | 1/1992 |
| JP | 07155410 | A | * | 6/1995 |
| JP | 2001340499 | A | * | 12/2001 |
| JP | 2003062135 | A | * | 3/2003 |
| JP | 2003144590 | A | * | 5/2003 |
| JP | 2004016654 | A | * | 1/2004 |
| JP | 2004195214 | A | * | 7/2004 |
| JP | 2004229869 | A | * | 8/2004 |
| JP | 2004242938 | A | * | 9/2004 |
| JP | 2004290313 | A | * | 10/2004 |
| JP | 2005000576 | A | * | 1/2005 |
| JP | 2005230332 | A | * | 9/2005 |
| JP | 2006116002 | A | * | 5/2006 |
| JP | 2006167279 | A | * | 6/2006 |
| JP | 2006296500 | A | * | 11/2006 |
| JP | 2006297117 | A | * | 11/2006 |
| JP | 2007020996 | A | * | 2/2007 |

* cited by examiner

GOLF HEAD

BACKGROUND OF THE INVENTION

1. Field of the Invention

The present invention relates to golf head and more particularly to a golf head structure that uses hard metal to make the main part and models the face and bottom by soft metal integral whole.

2. Description of the Related Art

In prior art, a golf head that is made of soft metal (like soft carbon steel) has the advantage of easy control and it is also easily to adjust the angle of the neck portion. But, the disadvantage is that the grooves on the face damages easily by hitting the ball hardily and the bottom wears down by grinding the ground. It is a practical solution by strengthening the face. For example, using hard metal to make a hitting plate and fixed it on the face. However, this is harmful to the control of the ball. The solution is making the face into a cup shape. The cup shape face has advantages of better bending elasticity and control. The wear-resisting character of the bottom can be improved by using hard metal. But, the face and the bottom are usually made and placed individually in prior art. So, the front bottom of the main part has no protection and damages easily.

SUMMARY OF THE INVENTION

The object of the present invention is providing a golf head, which has both advantages of a main part, which is made of soft metal, and a face and a bottom, which are made of hard metal, at the same time. Meanwhile, the face and the bottom are modeled integral whole to provide a better protection at the front bottom of the golf head.

To achieve the object of the present invention, the golf head of present invention including a main part, which is made of metal, having a body portion and a neck portion. A hitting part, which is made of metal that is harder than the main part, has a face portion and a bottom portion. The bottom portion that extrudes from the bottom of the face portion is modeled with the face portion integral whole. The hitting part connects with the body portion of the main part by the rim. The back of the face portion and the top of the bottom portion, which closes to the face portion, suspend in midair. The connective position of the body portion and the rear bottom portion crosses the central line of the bottom of the golf head and is partial to rear.

DETAILED DESCRIPTION OF THE INVENTION

Figure 1:
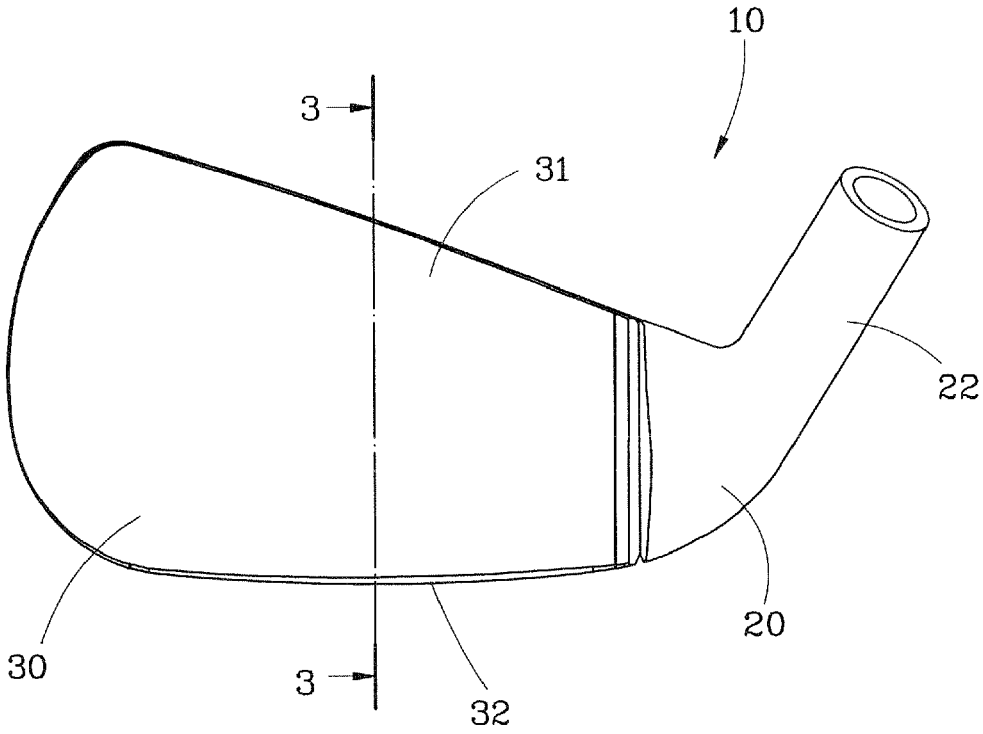
FIG. 1 is a front view of the first embodiment of the present invention.
Figure 2:
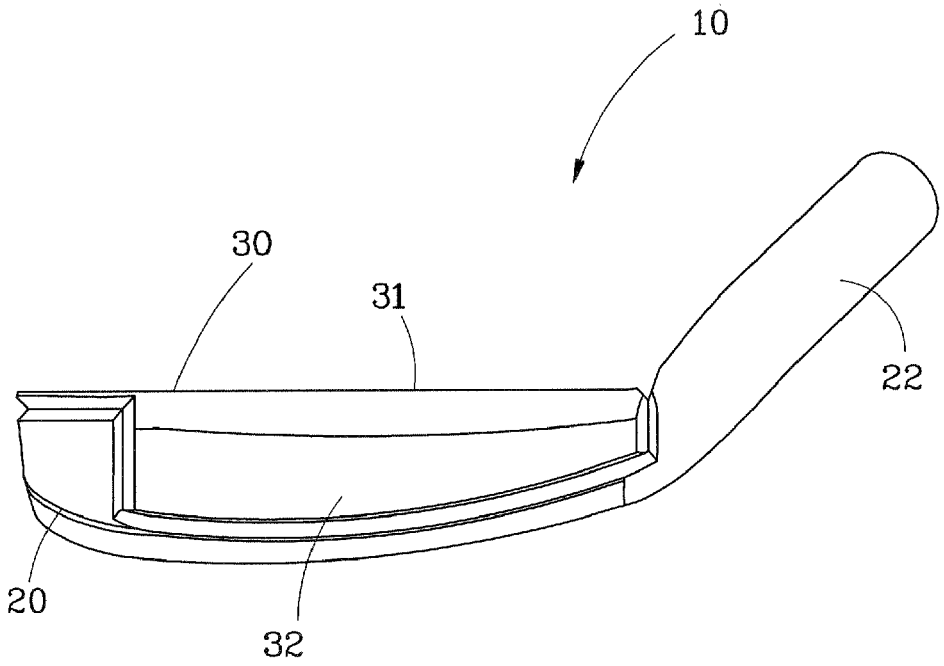
FIG. 2 is a bottom view of the first embodiment of the present invention.

Referring to FIG. 1 to FIG. 4, a golf head in the first embodiment of present invention including:

A main part 20 is made of metal under 30 in the hardness (HRC). The main part is made of stainless steel 304 in this embodiment and the hardness is 5~6 (HRC 5~6). It is quite soft. The main part includes a body portion 21 and a neck portion 22. The body potion 21 with a hole 215 at the middle has an up frame 211, a down frame 212, a toe portion 213 and a heel portion 214. A core portion 216 extrudes from the upside of the down frame 212.

Figure 3:
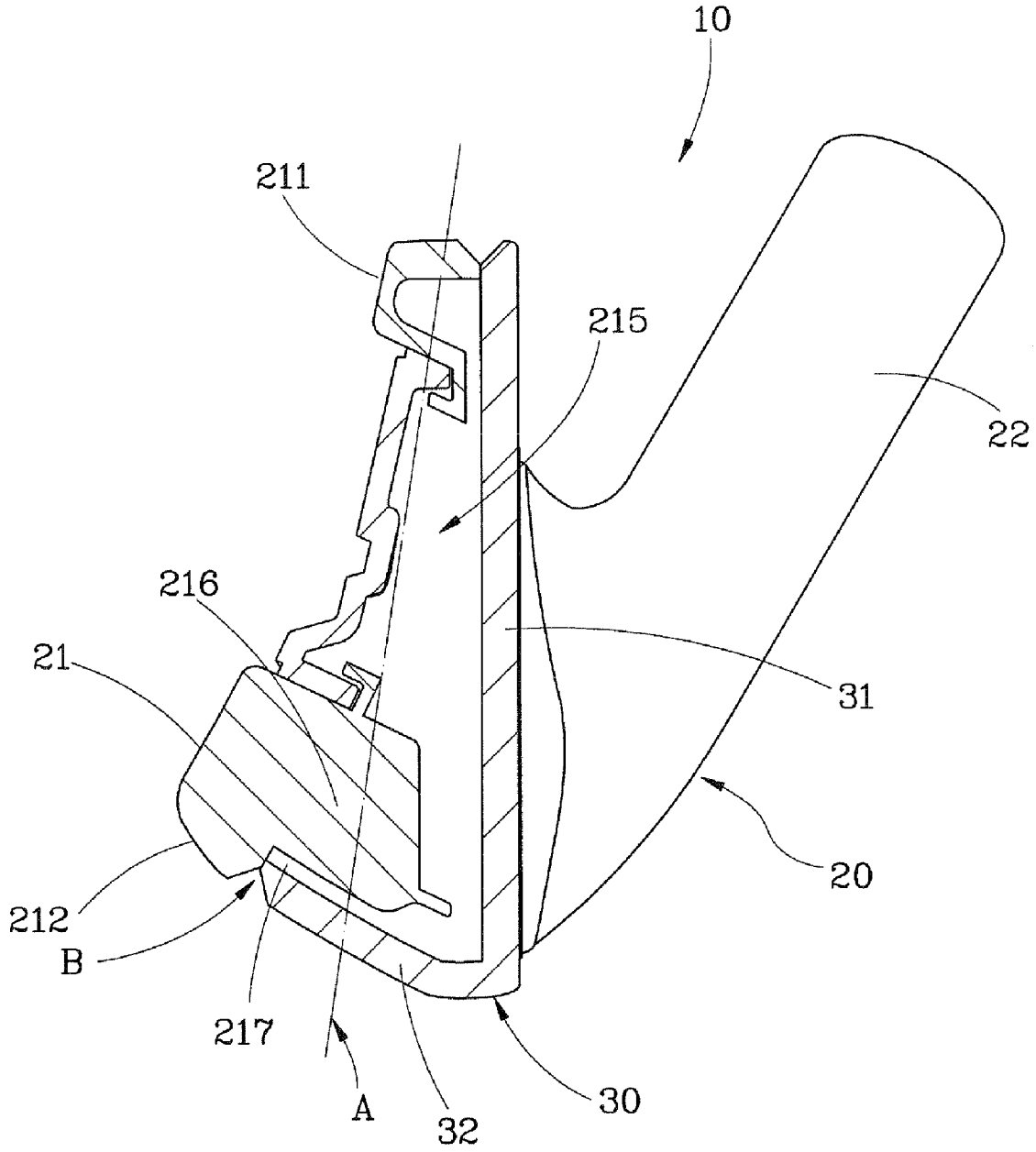
FIG. 3 is a section view at line 3-3 of the FIG. 1.

A hitting part 30 is made of metal over 30 in the hardness (HRC). For example, the metal can be titanium alloy (β 6-4 titanium, HRC 30~40) or stainless steel 450 (HRC 40~42) or stainless steel 174 (HRC 30) or maraging steel 465. The hitting part includes a face portion 31 and a bottom portion 32. The up rim of the face portion 31 connects with the up frame 211 of the main part and the rear rim of the bottom portion 32 connects with the down frame 212. The core portion 216 extends forward to the face portion 31 and maintains a distance between the face portion 31 and the bottom portion 32. That is to say, the hitting part 30 connects with the body portion 21 of the main part 20 by the rim. Meanwhile, the back of the face portion 31 and the top of the bottom portion 32, which closes to the face portion 31, suspend in midair. Referring to FIG. 3, the connective position of the body portion 21 and the rear of the bottom portion 32 crosses the central line of the bottom of the golf head 10 and is partial to rear. The connection method can be welding or brazing or them both. The thickness of the face portion 31 of the hitting part 30 is better between 1.83~5 nm to provide a better structurally strength and bending elasticity. The thickness of the bottom portion 32 is better between 1.0~2.5 nm to provide a wear-resisting character. A thinner thickness can provide a better elasticity and control.

Figure 4:
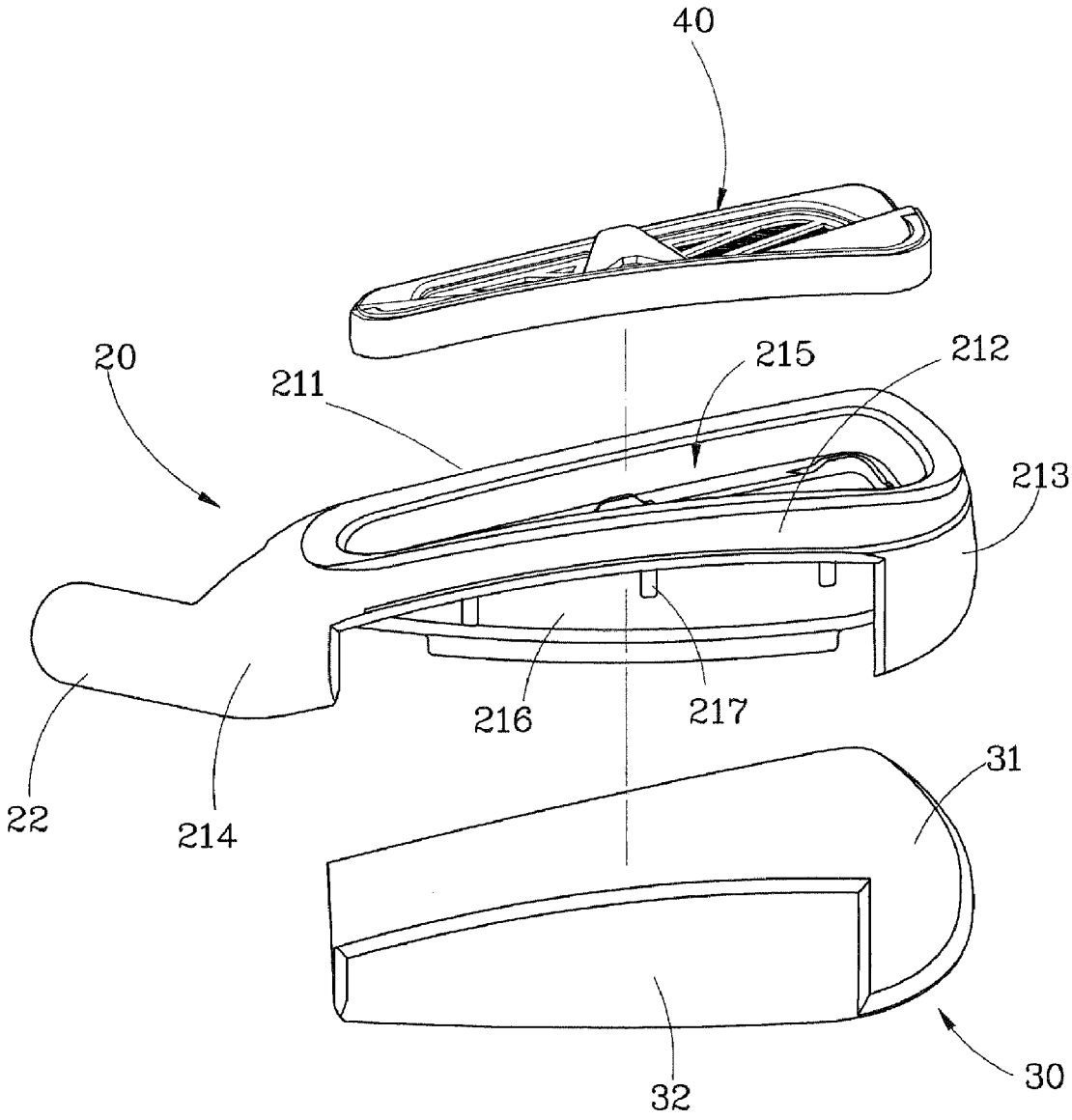
FIG. 4 is a perspective exploded view of the first embodiment of present invention.
Figure 5:
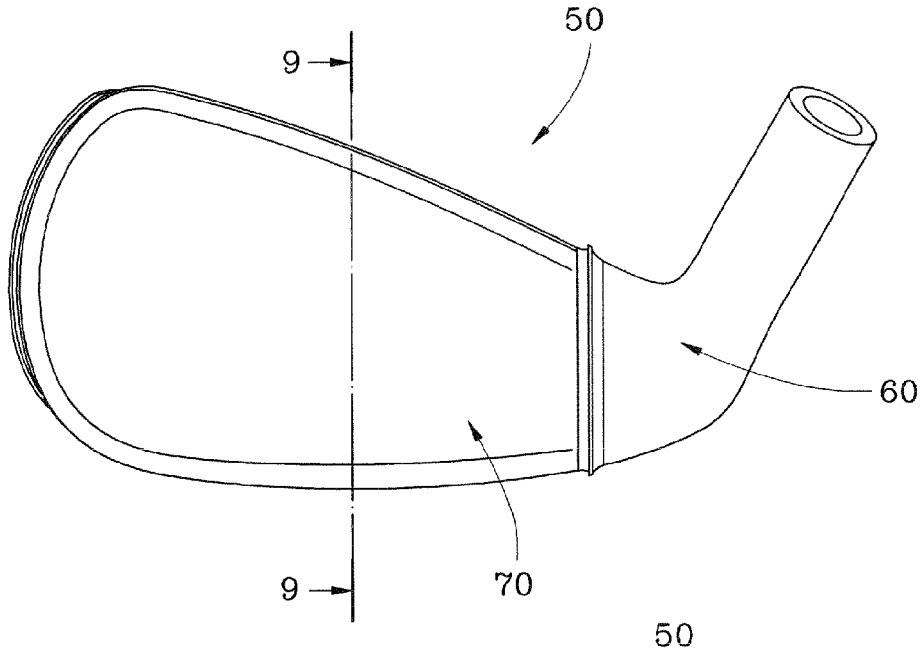
FIG. 5 is a front view of the second embodiment of the second embodiment of present invention.
Figure 6:
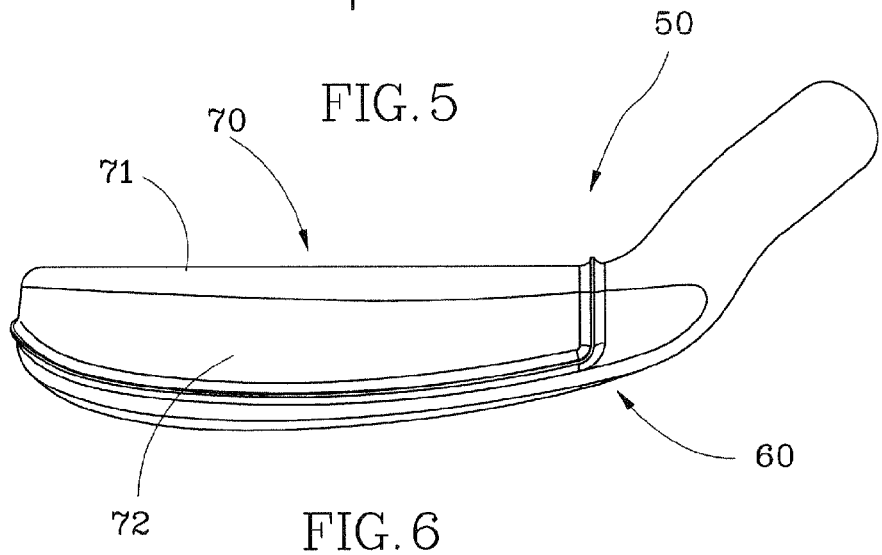
FIG. 6 is a bottom view of the second embodiment of the second embodiment of present invention.
Figure 7:
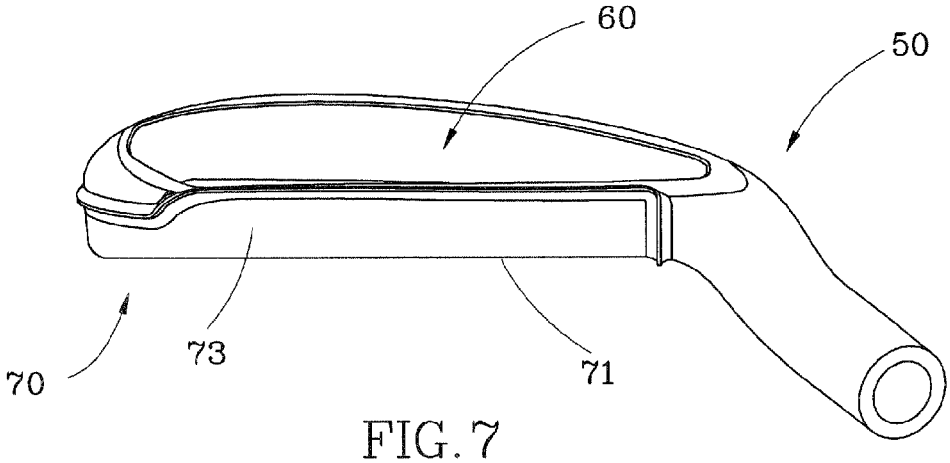
FIG. 7 is a top view of the second embodiment of the present invention.
Figure 8:
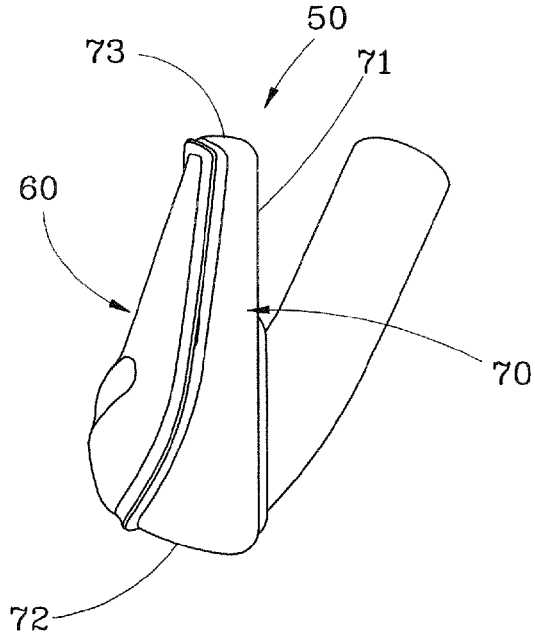
FIG. 8 is a left side view of the second embodiment of the present invention.

Referring to FIG. 3 and FIG. 4, there are ribs 217 provided on the bottom of the core portion 216 that closes to the down frame 212 in this embodiment. The ribs 217 touch the top of the rear bottom portion 32. This structure helps the assembly and makes sure the distance between the bottom portion 32 and the core portion 216.

Also referring to FIG. 3 and FIG. 4, a back part 40 is placed at the middle of the ringlike body portion 21 to seal the hole 215 of the body portion 21. This back part 40 can be made from plastic or fiber reinforced polymer in order to reduce the weight of the golf head. The back part 40 can also provide a convenience of putting a logo or pattern thereon. So, the manufactures can change the back part easily to satisfy the request of the customers.

Referring to FIG. 5 to FIG. 10, these figures show the golf head 50 of the second embodiment that includes a main part 60 and a hitting part 70.

Figure 9:
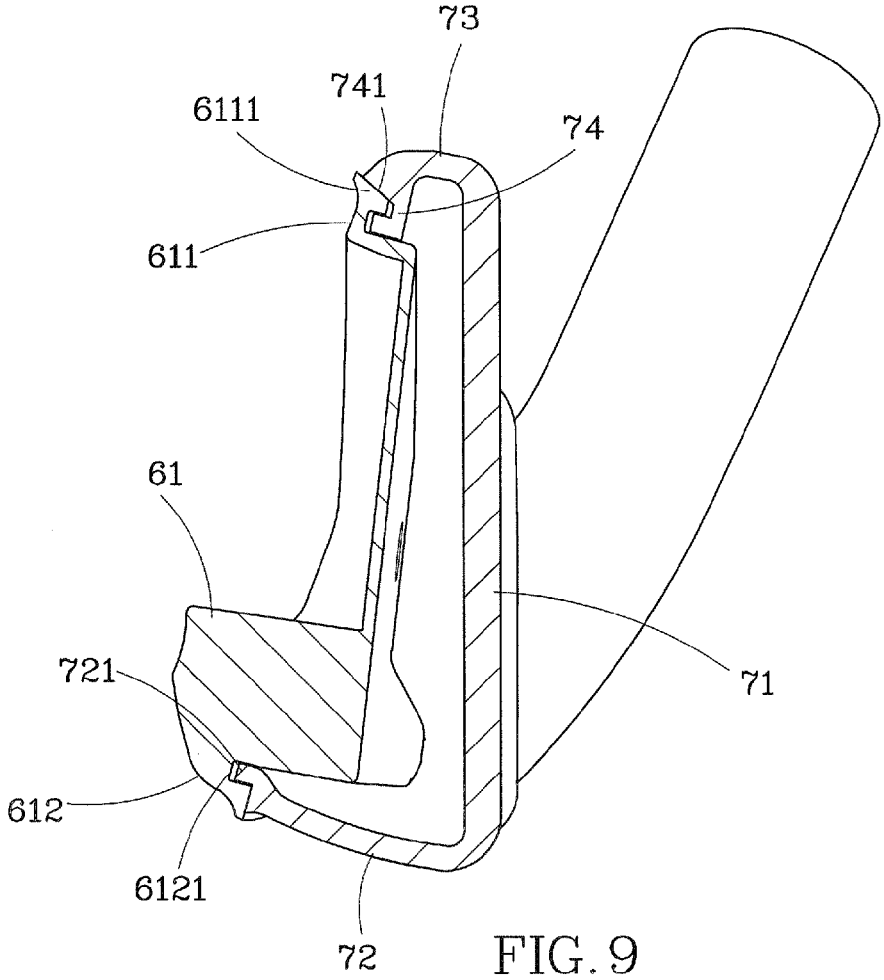
FIG. 9 is a section view at line 9-9 of the FIG. 5.
Figure 10:
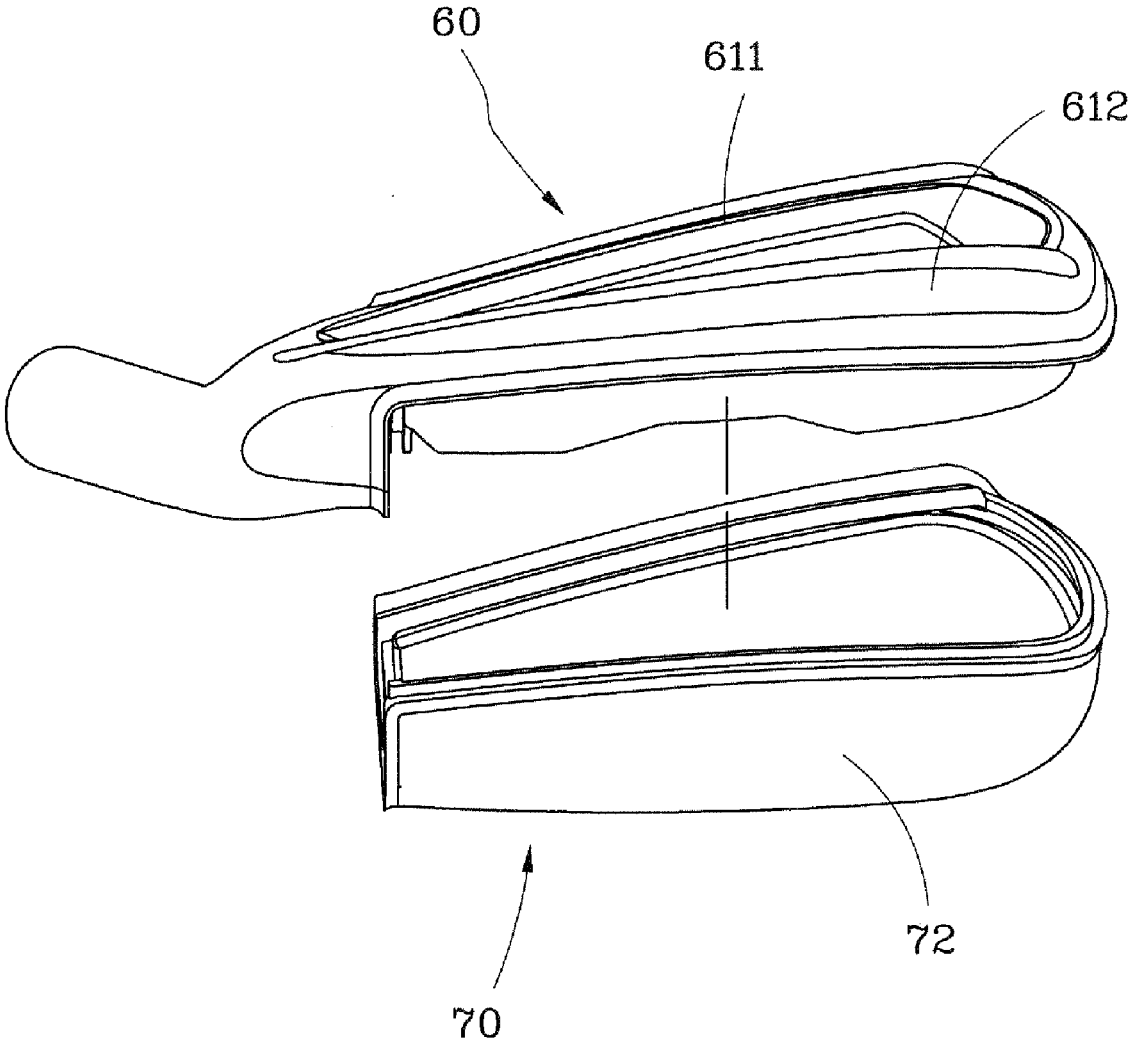
FIG. 10 is a perspective exploded view in second embodiment of present invention.

As the FIG. 9 and FIG. 10 shown, a top portion 73 extrudes backward from the top of the face portion 71. The end of the top portion 73 extends downward to form an end portion 74. The end portion 74 provides an engaging pit 741 thereon. A prominent portion 721 is provided at the rear of the bottom portion 72. The up frame 611 of the body portion 61 provides a hook 6111 to engage with the engaging pit 741. The down frame 612 of the body portion 61 provides a pit 6121. The prominent portion 721 can engage with the pit 6121 and combines with the body portion 61 by brazing. The solder fills up the space of the connective portion. The connective portion rises up as a flange as the FIG. 5 to FIG. 9 show. The flange will be grinded finally. So, the connective portion will not be able to recognize.

The body portion 61 has no hole thereon in the second embodiment, so the back part is not needed.

The width of the top portion 73 is between 5~6 nm in the second embodiment. Because that the hitting part 70 has a longer and thinner top portion 73 and bottom portion 72, the hitting part provides a better elastic effect and allows the face portion 71 having a larger bending range. The deformation quantity of the top portion 73 and the bottom portion 72 will absorb the strong hitting stress when hitting a ball. So, the stress, which acts on the connective portion, becomes smaller and the structures of the golf head can become harder and unbreakable.

What is claimed is:

1. A golf head, comprising:

a main part that is made of metal including a body portion and a neck portion;

a hitting part which is made of metal that is harder than the main part, having a face portion and a bottom portion;

the bottom portion that extrudes from the bottom of the face portion being modeled with the face portion as an integral whole;

the hitting part combining with the body portion of the main part by a rim thereof;

a back of the face portion and a top of the bottom portion, which closes to the face portion, being suspended in midair;

a connective position of the body portion and a rear of the bottom portion crossing a central line of the bottom of the golf head and being partial to the rear;

wherein the face portion of the hitting part has a thickness between 1.8-3.5 nm, and the bottom portion having a thickness between 1.0-2.5 nm.

2. The golf head as claimed in claim 1, wherein the hitting part is made of metal between 30-45 in the hardness (HRC).

3. A golf head as claimed in claim 1, wherein the body portion includes an up frame and a down frame; an up part of the rim of the face portion connects with the up frame of the main part and a rear rim of the bottom portion connects with the down frame; a core portion extrudes from an up part of the down frame and maintains a distance between the face portion and the bottom portion.

4. A golf head as claimed in claim 3, wherein the body portion of the main part includes a toe portion and a heel portion; the toe portion, the heel portion, the up frame and the down frame form a ringlike body portion.

5. A golf head as claimed in claim 1, wherein a top portion extrudes from the top of the face portion; the top portion connects with the top of the body portion.

6. A golf head as claimed in claim 1, wherein a top portion extrudes from 20 the top of the face portion and an end of the top portion extends downward to from an end portion; the end portion connects with the top of the body portion.

7. A golf head, comprising:

a main part that is made of metal including a body portion and a neck portion;

a hitting part which is made of metal that is harder than the main part, having a face portion and a bottom portion;

the bottom portion that extrudes from the bottom of the face portion being modeled with the face portion as an integral whole;

the hitting part combining with the body portion of the main part by a rim thereof;

a back of the face portion and a top of the bottom portion, which closes to the face portion, being suspended in midair;

a connective position of the body portion and a rear of the bottom portion crossing a central line of the bottom of the golf head and being partial to the rear;

wherein the bottom of the core portion that closes to the down frame provides ribs and the ribs touch the top of the rear bottom portion.

8. A golf head, comprising:

a main part that is made of metal including a body portion and a neck portion;

a hitting part which is made of metal that is harder than the main part, having a face portion and a bottom portion;

the bottom portion that extrudes from the bottom of the face portion being modeled with the face portion as an integral whole;

the hitting part combining with the body portion of the main part by a rim thereof;

a back of the face portion and a top of the bottom portion which closes to the face portion, being suspended in midair;

a connective position of the body portion and a rear of the bottom portion crossing a central line of the bottom of the golf head and being partial to the rear;

wherein tie bottom of the core portion that closes to the down frame provides ribs and the ribs touch the top of the rear bottom portion;

wherein the body portion of the main part includes a toe portion and a heel portion; the toe portion, the heel portion, the up frame and to down frame form a ringlike body portion; and wherein a back part is placed at a middle part of the ringlike body portion to seal a hole therein.

9. A golf head as claimed in claim 8, wherein the back part is made from plastic or fiber reinforced polymer.

* * * * *